US005529462A

United States Patent [19]

Hawes

[11] Patent Number: 5,529,462

[45] Date of Patent: Jun. 25, 1996

[54] UNIVERSAL PUMP COUPLING SYSTEM

[76] Inventor: David W. Hawes, 1490 Sullivan Loop, Owensboro, Ky. 42303

[21] Appl. No.: 207,357

[22] Filed: Mar. 7, 1994

[51] Int. Cl.[6] ..... F04B 17/00

[52] U.S. Cl. ..... 417/360; 417/361

[58] Field of Search ..... 417/360, 361

[56] References Cited

U.S. PATENT DOCUMENTS

| | | | |
|---|---|---|---|
| 3,880,553 | 4/1975 | Wolford et al. . | |
| 3,938,545 | 2/1976 | Nagy et al. | 417/360 X |
| 4,178,139 | 12/1979 | Seppänen et al. | 417/360 |
| 4,308,000 | 12/1981 | Oakes | 417/360 |
| 4,392,790 | 7/1983 | Shibata et al. . | |
| 4,564,041 | 1/1986 | Kramer . | |
| 4,661,047 | 4/1987 | Weis . | |
| 4,679,991 | 7/1987 | Harbison et al. . | |
| 4,726,742 | 2/1988 | Harbison et al. . | |
| 4,886,426 | 12/1989 | Surimak . | |

*Primary Examiner*—Richard E. Gluck
*Attorney, Agent, or Firm*—Middleton & Reutlinger; David W. Carrithers

[57] ABSTRACT

A universal pump coupling system that allows various style submersible pumps to be mounted to a pump mounting frame assembly to be used interchangeably within a single pump station system. The universal pump coupling system comprises a submersible pump holding device and universal guide rail assembly for use in both submersible and converted dry pit pump stations that allow numerous brands of pumps to be utilized in a single interchangeable system. The universal pump coupling system is particularly suitable for conversion of wet well/dry well pump stations to a single wet well pump station.

9 Claims, 4 Drawing Sheets

UNIVERSAL PUMP COUPLING SYSTEM

BACKGROUND OF THE INVENTION

Conventional coupling devices are generally designed to provide a method of interlocking a specific type or brand of submersible pump discharge outlet to a specially designed complementary fixed discharge conduit. These coupling assemblies are designed to allow the pump to sealably connect or disconnect to the discharge conduit without binding. The problem with conventional pump coupling devices is that they are specific for each manufacturer's submersible pump. In order to replace or repair pumps from pump stations that are malfunctioning, only pumps that are designed specifically and are manufactured by the same original pump company may be used in that pump station. There are no devices on the market that allows pumps manufactured by various companies to be used in another manufacturer's pump station. This requires that pump system operators replace malfunctioning pumps and rail systems with only the specific replacement parts designed for that individual station. Waste water pump station systems generally have various brands of pump equipment, requiring system operators to stock a large inventory of replacement parts which is time consuming and very expensive.

Another problem that exists with pump mountings is the frequent corrosion that occurs between the face of the pump and the discharge piping. This corrosion caused the face of the pump and the discharge piping to adhere to each other making it difficult to remove the pump from its resting position. In order to remove the pump, personnel must enter the pump station and manually break the bond between the pump and the discharge piping. Also removal and replacement of malfunctioning submersible pumps in the pump system is time consuming, requiring several personnel and exposing these individuals to possible unsafe conditions due to accumulation of poisonous gas within the pits. Maintenance personnel are also exposed to possible hazards from the wet and slick environment within the sewage pits and from connection of pump wiring into the stations electrical system. Furthermore, conventional pump systems do not address the removal and replacement of dry pit style pumps with submersible pumps, nor provide a means of conversion of wet well/dry well lift stations into single wet well systems employing interchangeable submersible pump assemblies as does the present invention.

The universal pump coupling system of the present invention provides for a submersible pump coupling device and rail system that allows any brand of submersible pump to be used in any pump station. All wet well piping is removed and replaced with heavy duty suction hose. The hose has one quick disconnect fitting on each end. The discharge piping and all discharge valving is placed above ground for easy access of the user. The entrance to the discharge piping also has a quick disconnect fitting that enables it to be connected to the suction hose. The entrance to the discharge piping is mounted generally at an angle or perpendicular to the rail system with enough clearance to allow the pump mounting device to pass by without touching. Moreover, the electrical and heat sensor cords are fitted with industrial twist type plugs which are coded for each specific plugs in order to facilitate ease of identification. The pump system of the present invention may be utilized in sump or sewage pits and basins and constructed for easy removal from these pits without requiring personnel to enter the confined space of the wet well or pit to maximize safety and downtime.

SUMMARY

The universal pump coupling system including a pump holding device and guide rail assembly for use in both submersible and converted dry pit pump stations overcomes the disadvantages of conventional pump systems and connection devices by providing the system operator with a single interchangeable pump mounting frame and guide rail.

The universal pump coupling system comprises a submersible pump having an inlet and an outlet. A frame assembly supporting the pump is removably mounted thereto. The frame assembly comprises a base plate having a an opening therethrough in flow communication with the pump inlet. The base plate includes a guide means integrally formed therein and has a plurality of legs attached to the bottom for supporting the base plate. The base plate has at least two support members or posts extending upwardly supporting a top plate having a guide means integrally formed therein alignable with the guide means of the base plate. A guide rail defining a vertical longitudinal axis is complementary sized and shaped for slidably engaging the guide means of the top plate and the base plate. The guide rail is secured to a lift station wall by a holding means such as stainless steel brackets and bolts. A flexible discharge conduit is removably secured to the pump outlet using quick disconnect fittings. A means for lifting the frame assembly is removably secured to the top plate for raising and lowering the submersible pump slidably engaging the guide rail for selective coupling and uncoupling of the flexible discharge conduit with the pump outlet.

The pump mounting frame is made from a non-corrosive material such as stainless steel or aluminum. Each pump is fitted with a pump mounting frame that may be modified according to pump specifications to accommodate a specific size or style of the pump dependent upon the height, diameter, discharge point, or any other specific characteristic of the pump. The pump coupling system differs from all other prior art devices because the mounting frame is designed to hold the pump from the mounting rail and connect to fixed discharge conduit located outside the wet well environment via removable, flexible conduit.

The guide rail assembly and pump holding device of the present invention is constructed of a non-corrosive material so that the environment within these pits do not cause excessive corrosion of the pump system that would create a binding between the elements of the system. Discharge piping within sewage pits of the prior art systems is typically exposed to environmental conditions which cause corrosion and deterioration.

Each pump secured to a pump mounting frame is fitted with a non-corrosive quick disconnect coupling. The quick disconnect coupling must be in a vertical upright position. An adaptation device is retrofitted to the discharge opening of certain types of pumps in order to secure the disconnect coupling in the proper position.

The guide rail for the universal pump coupling system may be constructed from metal; however, a non-corrosive material such as aluminum, stainless steel, noncorrosive metal alloy, or synthetic material such as fiberglass is preferably used to fabricate the I-beam shaped guide rail.

The guide rail system provides a means to raise and lower the pump and pump mounting frame from a set position in the wet well and secure the pump mounting frame and pump against rotation.

Conventional pump coupling devices are designed to fit securely to a fixed conduit. The universal pump coupling system does not use a fixed conduit within the wet well. All fixed conduit within the pump station is outside of the wet well where environmental conditions are not as conducive to corrosion. The discharge conduit used in the universal pump coupling system within the wet well is a flexible, high quality hose. This discharge hose is fitted with quick disconnect couplings at each end. The discharge hose transports the pumped material outside of the wet well to the fixed discharge conduit. The use of hose within the wet well versus use of fixed discharge conduit assures the operator that the pump will not bind with the discharge conduit.

All fixed discharge piping and valving are located outside of the wet well environmental conditions. The inlet portion of the fixed discharge piping is fitted with a quick disconnect coupling in a downward vertical position located above the pump mounting frame. This disconnect coupling and piping is offset slightly to allow the pump mounting frame and pump to pass when raising or lowering. The positioning of the pump discharge quick disconnect and the inlet fixed conduit quick disconnect maintains the discharge hose in a vertical position free of stress when the pump is in operation.

The end of each submersible pump cord is fitted with the male portion of a twist lock plug-in. Each pump station electrical panel is fitted with female twist lock plug-in receptacles which may be tagged or color coded for ease of identification. The use of twist lock (or comparable) plug-ins allows for quick and safe connection and disconnection to the electrical system. Both the pump station electrical system and the individual pumps are checked for proper coordinated wiring. This assures the system operator that the pump rotation will be correct each time a pump is placed into operation.

The universal pump coupling system of the present invention is also used to convert wet well/dry well style pump stations to single wet well submersible stations. This conversion is achieved by removing approximately two-thirds of the bottom portion of the wall that separates the wet well from the dry well creating a single wet well unit. In most cases, this single wet well unit can nearly double the holding capacity of the pump station. The elimination of dry wells in pump stations and the subsequent replacement with the universal pump coupling system is advantageous to the system operator because down time is reduced, less maintenance is required, there is easy access to discharge pipes and valves above the station, and confined space entry is eliminated.

The universal pump coupling system allows standardization within pump station systems eliminating the need to purchase new or identical pumps. All submersible pumps within the system can be standardized through the use of the pump mounting frame and universal guide rail assembly. Malfunctioning pumps can be removed and replaced quickly because the pump discharge will not bind on discharge conduit as with .known prior art devices. Electrical connection is also achieved quickly with the use of twist lock plug-ins. Each feature of the universal pump coupling system is designed to provide the operator with a quick, safe, and cost effective means to service malfunctioning pumps.

It is an object of the present invention to provide a pump mounting frame having a secure mounting for the pump having a holding device that is fitted to a guide rail system, wherein the holding device used in combination with the guide rail system stabilizes the pump against rotation.

It is another object of the present invention to provide a universal pump coupling system creating better operating conditions and providing system operators with quick, easy, and safe removal and replacement of submersible pumps when a malfunctions occur.

It is another object of the present invention to select a guide rail means using a noncorrosive material.

It is another object of the present invention to select a material that operates in conjunction with the pump mounting frame in a smooth, non-binding motion.

It is another object of the present invention to provide a a single type of guide rail within the pump station system so that all pump mounting frame's are interchangeable.

It is another object of the present invention to provide a a single type of guide rail within the pump station system that will hold the pump mounting frame securely in place.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF PREFERRED EMBODIMENT

Figure 1:
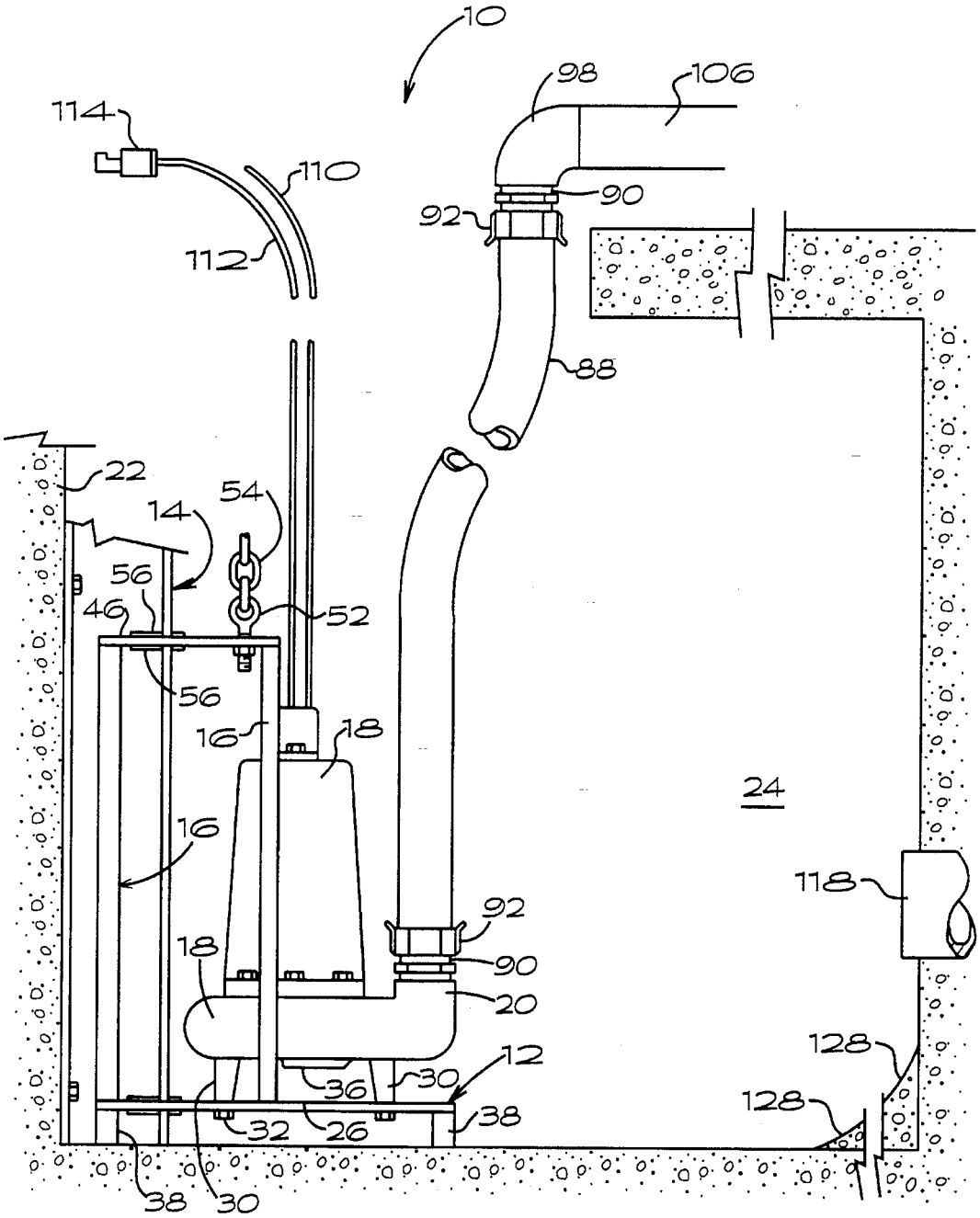
FIG. 1 is a partly broken, cutaway side view of the universal pump coupling system of the present invention showing a pump supported by a mounting frame in a wet well pump station.

Referring now to the drawings, FIG. 1 illustrates the universal pump coupling system 10 having a submersible pump including a pump inlet and pump outlet, a pump mounting device 12 and a guide rail assembly 14 positioned within a wet well sewage lift station.

Figure 2:
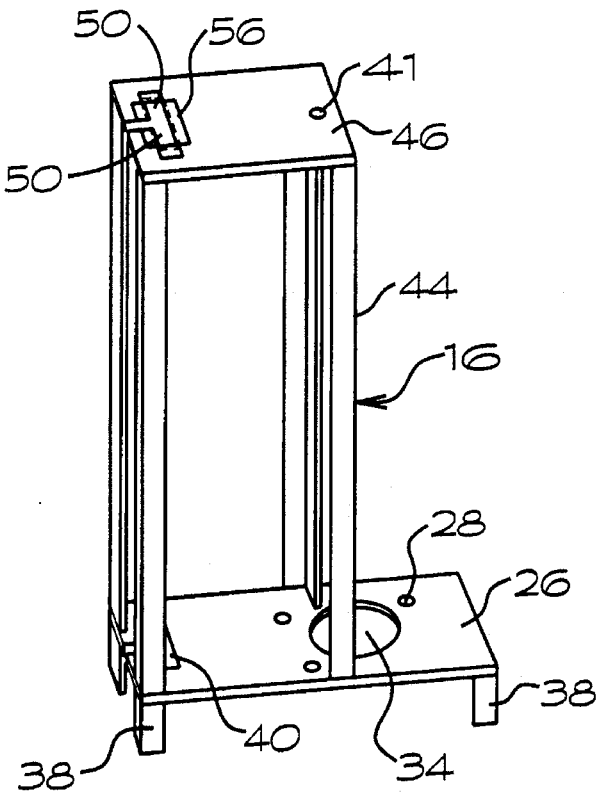
FIG. 2 is a perspective view showing the pump mounting frame of the present invention.
Figure 4:
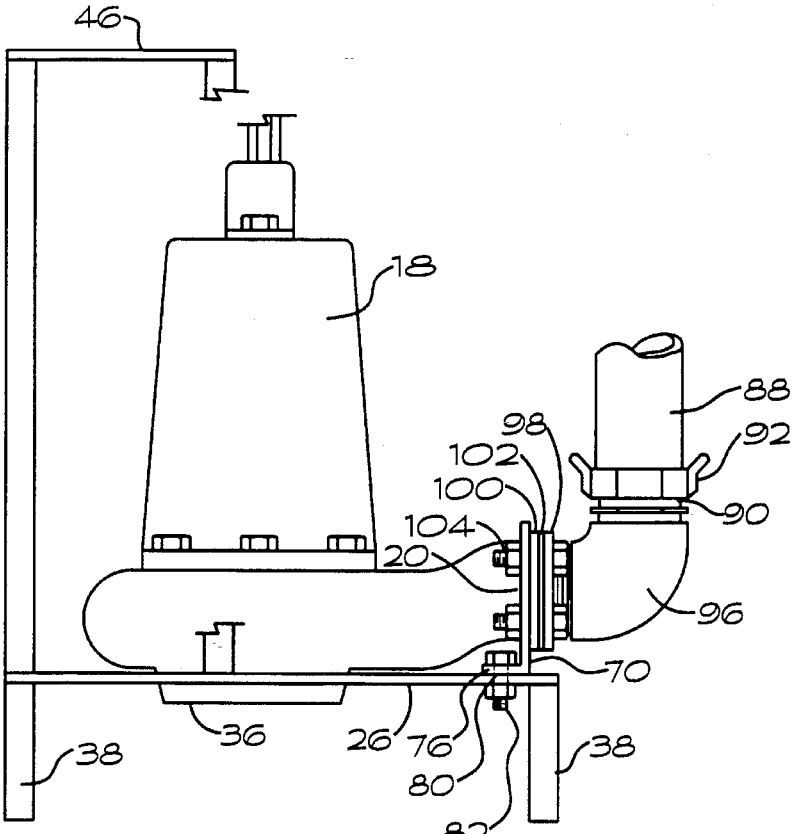
FIG. 4 is a side elevational view showing a submersible pumps secured directly to the pump mounting frame of FIG. 5.

A major component of the pump mounting device 12 is the pump mounting frame 16 shown in FIG. 2, which enables different types of pumps to be used interchangeably within a single pump station. The pump mounting frame 16 provides a means to hold in place any manufacturers pump and motor assembly 18 with its discharge outlet 20 directed outwardly away from the inside wall 22 of the pump station wet well 24. In the preferred embodiment, the pump discharge outlet 20 is positioned at an angle of from about 45 degrees to about 135 degrees, and more preferably at a 90 degree angle with respect to the wet well wall 22. The mounting frame 16 is modified dimensionally to provide proper positioning for pumps having different structural features as shown in FIG. 4. The mounting frame 16 is designed to hold the pump 18 in a generally vertical position and provide a stable framework that keeps the pump 18 from rotating on its axis while in operation. The pump mounting frame 16 and submersible pump 18 once properly attached together forms a single unit providing a universal pump mounting device 12 for raising and lower the pump 18 into its proper operating position within the pump station wet well 24.

Figure 7:
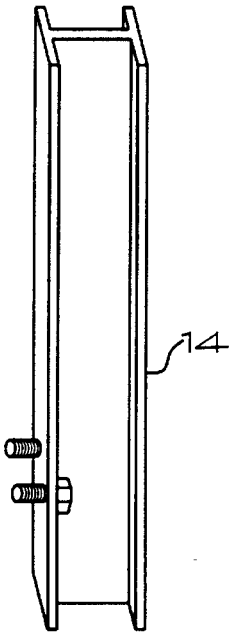
FIG. 7 is an elevated perspective view showing I-beam guide rail of the present invention having anchor bolts extending therefrom.

The universal pump coupling system 10 requires the use of a single rail 14 within a pump station system. It is advantageous to the system operator to require this single rail 14 to facilitate pump interchangeability using the pump mounting frame 16. As illustrated in the preferred embodiment, an "I-beam shaped" rail 14 is secured to the inside wall 22 of the wet 24 by holding means such as stainless steel bolts, such as is shown in FIGS. 1 and 7. It is contemplated that a "T-shaped" beam, two "C-channel" beams, a single pipe, or any number of other rail configurations may also be utilized to cooperatively engage in guide slots formed within the pump mounting frame 16; however, the "I-shaped" configuration provides a inexpensive, readily available, strong support which is easily fastened to the wall or anchored within the concrete floor of the dry 24. The rail 14 may be composed of metal such as steel, but is preferably composed of noncorrosive material such as stainless steel or aluminum, and even more preferably the rail 14 is composed of fiberglass.

The mounting frame 16 shown in FIGS. 1 and 2 include several features to properly secure the heavy submersible pump 18 in position in sliding engagement with the rail 14. The mounting frame 16 includes a base plate 26 having a plurality of holes 28 spaced apart in a manner to properly align and secure a plurality of pump legs 30 to the frame 16 by securing means such as bolts 32 preferably composed of stainless steel. The base plate 26 includes a generally central opening 34 in fluid communication with the pump suction inlet opening 36 for permitting fluid connection with liquid to be sucked from below the frame 16 into a submersible pump 18 mounted directly onto the base plate 26 as shown in FIG. 4. Some types of pumps 18 may also be supported by legs 30 mounted to the base plate 26 such as is shown in FIG. 1. The submersible pump's 18 suction inlet opening 36 size determines the diameter of the central opening 34. The base plate 26 is also fitted with mounting frame legs 38. The length of the mounting frame legs 38 determine the distance the pump inlet 36 sets from the bottom of the pump station wet well 24. The frame legs 38 are designed to be a specific height based on the desired distance of the pump inlet opening 36 to the lift station floor. The mounting frame leg 38 height can be altered in order to provide optimum operating conditions and suction for various pump 18 designs. Mounting the pump 18 above the wet well floor rather than directly to the floor provides optimal fluid flow and prevents accumulation and clogging of the pump 18 inlet with sludge solids.

In the preferred embodiment, the base plate 26 includes a guide means formed therein consisting of a base slot 40, more particularly, a "T-shaped" slot, on the side of the mounting frame 26 positioned toward the wall 22 as shown in FIGS. (2, and 4–6). The base slot 40 is in cooperative slidable engagement with the guide rail 14, more particularly, an "I-beam shaped" guide rail 14, secured to the inside wall 22 of the wet well 24, such as shown in FIGS. 1 and 7. It is contemplated that the guide means 40 and guide rail 14 may be configured in various other complementary sizes and shapes. The slot 40 formed in the bottom plate 26 of the pump mounting frame 16 provides stability for raising and lowering the pump 18 in the wet well 24. The shape of the slot 40 provides a means for adapting the mounting frame 16 so that any submersible pump 18 mounting on the frame 16 is interchangeable with any universal pump coupling system 10 at other pump stations within the water and waste treatment system.

As shown in FIG. 2, four support members 44 forming legs in the shape of angle iron and constructed from noncorrosive material such as stainless steel, extend upwardly from the base plate 26 forming to support a top plate 46. The top plate 46 is generally sized to be smaller than the base plate 26 to provide for easy installation and unrestricted access to the pump 18, and further to allow the pump electric/control cords to extend upwardly from the pump 18 toward the surface without interference from the top plate 46. The top plate 46 is also fitted with a guide means consisting of a "T-shaped" top slot 50 on the side of the mounting frame 26 positioned toward the wall 22 and in alignment with the base slot 40 for cooperative slidable engagement with the "I-beam shaped" rail 14 secured to the inside wall 22 of the wet well 24. The top slot 50 and base slot 40 provide overall stability to the universal pump coupling system 10 when stationary as well as for raising and lowering the pump mounting device 12. The top plate 40 includes a hole 41 that is connected to a lifting means consisting of a stainless steel eye-bolt 52 that is connected to a lift chain 54 for permitting removal of the pump mounting device 12 from the wet well 24 as illustrated in FIG. 1. The hole 41 for the eye-bolt 52 is positioned according to the center of gravity of the pump 18 and mounting frame 26 in order to balance the total weight. This is imperative in order to lift the pump 18 and mounting frame 18 assembly in a smooth ascension from the wet well 24. The frame 26 and submersible pump 18 slidably engage the guide rail 14 for raising and lowering the universal pump coupling system 10 and for coupling and uncoupling the pump outlet 20 with a flexible discharge conduit the extends outside of the wet well 24.

Figure 6:
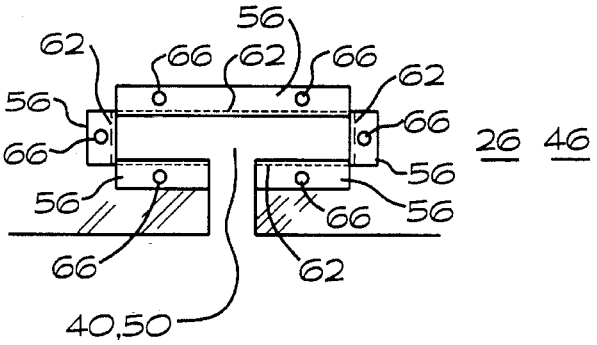
FIG. 6 is a top plan view of the slot of FIG. 2, including a friction reducing material lining the slot of the pump mounting frame engaging the guide rail.
Figure 8:
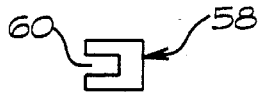
FIG. 8 is an elevated side view showing a strip of the friction reducing material which lines the slots of the pump mounting frame.

The use of a friction reducing material 56 is an important feature of the present invention to prevent binding and promote smooth sliding operation of the pump mounting frame 16 in cooperative sliding engagement with the rail 14. As shown in FIG. 6, the base slot 40 and top slot 50 in the preferred embodiment are lined with ultra high molecular weight friction reducing material 56 such as: polyethylene, ("UHMW"), Teflon, graphite fiber, or some other noncorrosive, nonabrasive smooth material, such as a synthetic polymer in order to provide a non-binding surface between the slots 40, 50 and the rail 14. As shown in FIGS. 2 and 6, the friction reducing material 56 be in the form of a flexible strip folded around the edges 62 of the plate 26, 46 and fastened thereto; or preferably a block 58 of friction reducing material 56 having a groove 60 therein, which may be attached to the slot 40, 50 in a tongue and groove arrangement wherein the edge 62 of the slot 40, 50 forms a tongue in cooperative engagement with the groove 60 so that the friction reducing material 56 lines the slot 40, 50. The strips or blocks 58 may include a plurality of holes 64 therethrough alignable with holes 66 formed within the plates 26, 46 for cooperative engagement with screws or bolts 68 for removably securing the friction reducing material 56. FIG. 6 shows the positioning of the friction reducing material 56 covering the edge 62 of the guide means 40, 50 shown in phantom lines.

Figure 3:
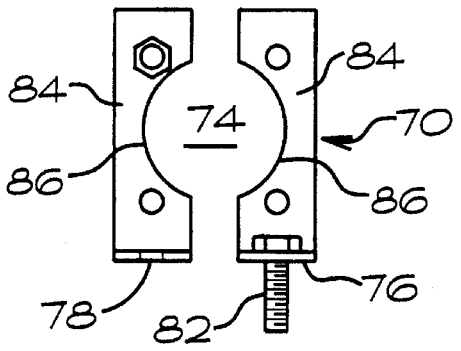
FIG. 3 is an elevational plan view showing a pump mounting bracket for securing a pump to a pump mounting frame.
Figure 5:
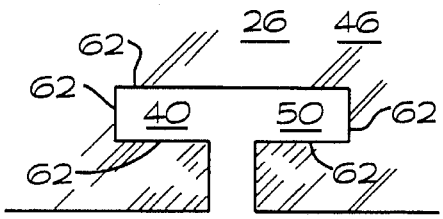
FIG. 5 is a top plan view of a slot formed within base plate of the pump mounting frame of the present invention.

A pump mounting means such as one piece mounting bracket 70, connected by is utilized in combination with the mounting frame 16 for pumps 18 designed without legs 30, such as shown in FIG. 4. As shown in FIG. 3, the pump mounting bracket 70 of the preferred embodiment consists of a split main body comprising panels 84 having a pump discharge outlet hole 74 formed therein. The panels 84 may be attached to the frame 16 separately or removably secured to one another by holding means. The bracket 70 is bent at the bottom forming an attachment flange 76 having mounting holes 78 therein for attachment to the base plate 26 and alignable with mounting holes 80 formed therethrough with fastening means such as stainless steel bolts 82. The two sections of panels 84 each have a portion of a semi-circular aperture 86 formed between them adapted to surround the pump discharge outlet 20. The attachment flange 76 is simply removably secured to the base plate 26, and the single bracket 70 or the half brackets 84, are aligned with and removably secured to the pump outlet flange 20. Additional fastening means such as one or more non-corrosive U-bolts, preferably composed of stainless steel may be used to securely fasten the pump 18 to the base plate 26.

As shown in FIG. 1, the pump 18 is mounted to the pump mounting frame 16 so that the discharge outlet 20 extending upwardly in a vertical direction. Some pumps 18 require a pump discharge outlet adaptor 96. The adaptor 96 may be formed in a variety of shapes to fit specific pumps as long as the adapter provides a means for allowing the outlet to be generally perpendicular to the lift station floor in an upright position. The adaptor 96 shown in FIG. 4 is an elbow shaped adapter 96 which permits the flow of liquid from the discharge outlet 20 to extend outwardly and upwardly in a vertical direction, as is illustrated in FIG. 4. Such an adapter 96 is commercially available and usually has a flange 98 on the pump 18 connection end having holes alignable with holes provided in the flange 100 of the pump discharge outlet 20. Usually a gasket 102 is placed between the pump flange 100 and adapter flange 98 which are secured together by holding means such as stainless steel bolts 104.

Each submersible pump 18 and discharge hose 88 is fitted with a cam-lock quick disconnect assembly 89 composed including a male cam-lock quick disconnect coupling 90 and female cam-lock quick disconnect coupling 92 of a non-corrosive material such as a plastic (i.e. nylon, PVC, or polyethylene), aluminum, brass, or stainless steel. The pump 18 in FIG. 4, and the adapter 96 in FIG. 1 are fitted and threadably engaged, with a male cam-lock quick disconnect coupling 90. The discharge hose 88 is fitted with a cooperately engaging female cam-lock quick disconnect coupling 92. The opposite end of the discharge hose 88 is also fitted with a female cam-lock quick disconnect coupling 92; however, an interlocking male cam-lock quick disconnect coupling 90 could be used to cooperatively engage a fixed discharge conduit 106 located outside of the wet well.

A unique feature of the universal pump coupling system 10 is the use of the flexible discharge hose 88 which serves as a permanent discharge conduit within the wet well 24 of each pump station as opposed to conventional rigid pipe installations. The flexible discharge hose 88 in the preferred embodiment is made of a thick walled high strength ribbed suction hose 87. Such a hose is usually composed of polymer fibers and rubber. Hoses may also be obtained utilizing steel reinforcement in the form of wire. The length of the flexible hose 88 should have some slack and be slightly longer (approximately 2–3 inches) than the distance between the male cam-lock quick disconnect 90 of the submersible pump 18 in its lowered fixed position in the wet well 24, and the male cam-lock quick disconnect 90 of the fixed discharge conduit 106 located above the wet well 24. The extra length provides the system operator enough slack within the flexible conduit 20 to connect or disconnect the cam-lock couplings 90, 92 when installing or replacing a submersible pump 18.

All fixed discharge piping in the universal pump coupling system 10 is located outside of the wet well 24 environment the preferred embodiment, a male cam-lock quick disconnect coupling 90 is secured to the fixed discharge piping 106 with a 90 degree elbow adapter 98 as illustrated in FIG. 1. The adapter 98 is connected to the fixed discharge horizontal piping 106 and valving, (not shown), located above the wet well 24. The piping and valving includes a horizontal section of fixed discharge pipe 106, a flanged check valve 99, a flanged gate valve or any other flow through valve 101 that can closed during repair, a flanged 90 degree elbow adapter 98, and a flanged "T" or "cross" 103 connected to the receiving force main 105. It is recommended that each pump station have a minimum of two submersible pumps 18 connected to fixed discharge piping 106.

Unlike conventional 3-phase electrical hard wiring 240/480 volt connections for waste water pumps, the universal pump coupling system 10 electrical system is designed so that individuals with very little electrical training could safely and easily connect each submersible pump 18 to a power source. The submersible pumps 18 have two cords providing electrical power and sensor means in electrical communication with the submersible pump electrically connected with a electrical panel board, with twist lock plugs placed above the wet well 24 environment. These cords include the electrical cord 110 connected to a power source for running the pump 18, and a heat sensor cord 112 connected to an indicator source to which may be connected a "chatterbox" (not shown) for communicating a message to a control center indicating the pump 18 requires maintenance due to heat buildup in the pump bearings or motor. Each cord 110, 112 is fitted with the male portion of a twist-lock plug-in 114. The electrical panel power source and heat sensor source are fitted with the corresponding female portion 115 of a twist-lock plug-in 114, or comparable high quality corrosion resistant plug-in. Pump rotation, which is dependent upon wiring within each plug 114 portion, is checked and set in each pump station and each replacement pump 18 within the system. The female power receptacle wiring is preset based on pump rotation. Therefore, when pump 18 replacement is required, system personnel are able to place the replacement pump 18 into service with the assurance that all wiring is proper.

When converting an existing dry well 124 pump stations to a well pump station 24, the universal pump coupling system 10 operator is not restricted to converting only the pump stations that are already designed for submersible pumps 18. The universal pump coupling system 10, is particularly suitable for conversion of an dry well 124/wet well 24 systems shown in FIG. 9 into single wet well 24 system as shown in FIG. 1. Due to the safety hazards associated with dry wells 124 which require maintenance personnel to climb into a dry well pit, (often containing poisonous gases), these dry wells 124 may be converted into wet wells 24 using the aforementioned universal pump coupling system 10.

Figure 9:
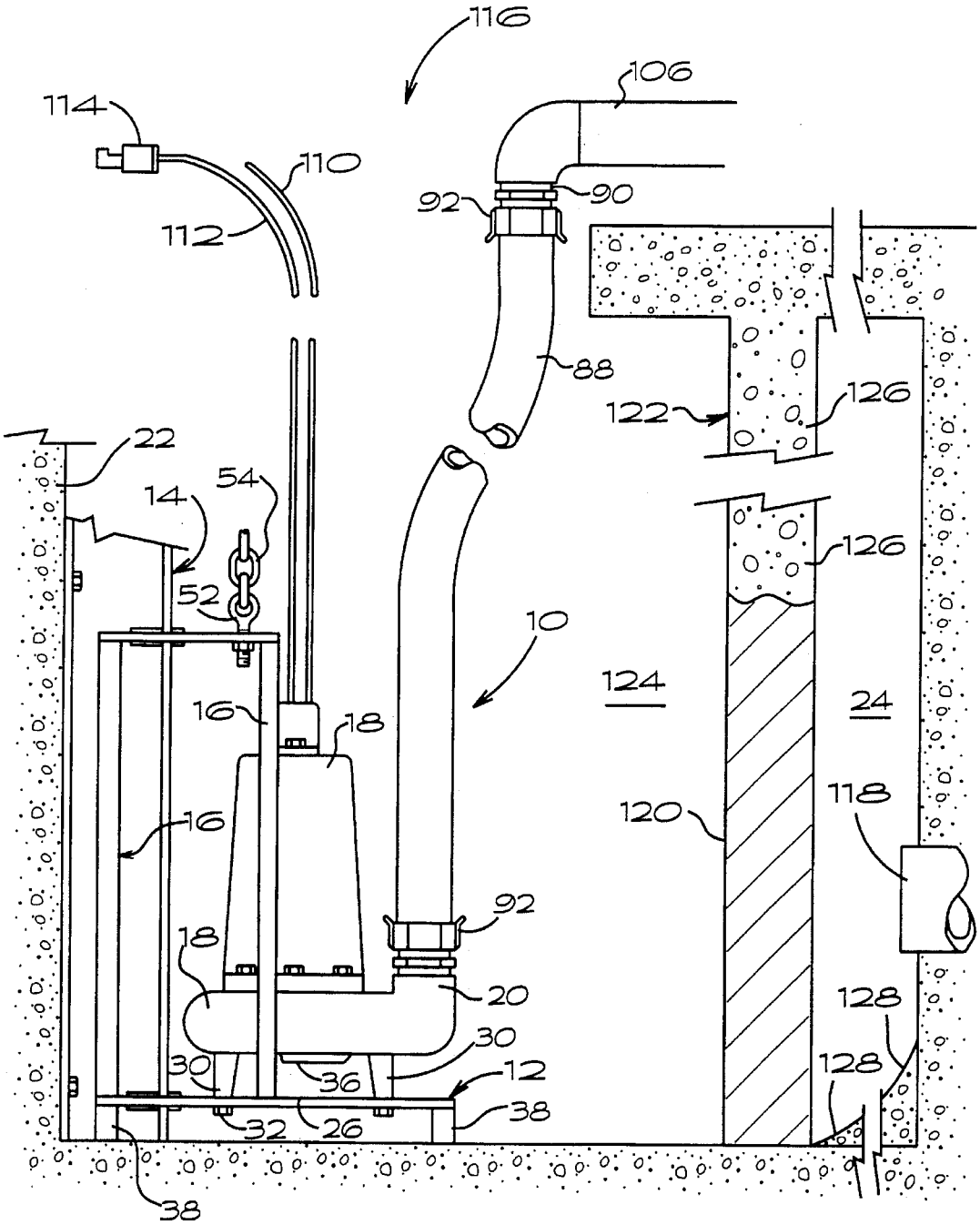
FIG. 9 is a partly broken, cutaway side view of the universal pump coupling system of the present invention utilized in the conversion of a wet well/dry well pump station to a single wet well pump station.

FIG. 9 shows a cross section of a wet well/dry well pump station 116 that has been converted using the universal pump coupling system 10. Conversion of wet well/dry well pump stations 116 to single well systems 24 is requires several steps. The changeover can only be achieved after the universal pump coupling system 10 are installed according to the aforementioned specifications including the fixed discharged conduit piping 106, valving, and electrical panel system 108 (not shown) are ready to be placed into service. Sewage is then restricted from entering the station 116, by using an existing valve or by plugging the sewage pipe inlet 118 or by diverting the sewage upstream from the station 116. All of the remaining sewage is removed from the wet well 24, such as with a portable pump. Approximately, the bottom two-thirds 120 of the dividing wall 122 is knocked out between the wet well 24 and dry well 124 leaving the remaining one-third 126 of the dividing wall 122 in place. It is advantageous to leave the remaining dividing wall 126 in an arch shape (or triangular shape) with the highest point (narrowest wall height) being located in the center of the dividing wall 122. Leaving a portion of the arched dividing wall 126 forms a narrow passage or restriction between the dry well 124 and wet well 24. Water flowing into the dry well portion 124 from the wet well 24 portion creates a type of venturi effect increasing the velocity of the flow of liquid through the arch restriction whereby the velocity decreases as the liquid flows into the larger dry well 124, creating turbulence and eddies which facilitates mixing of the sewage. Although not absolutely necessary, it is desirable to clean the floor of the wet well 24 and pour concrete providing a sloped floor 128 sloped toward the pump 18. The sloped concrete floor 128 may be extended into the dry well 124 area near the pump 18 to provide the optimum protection against sludge build-up such as is shown in FIG. 9.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A universal pump coupling system, comprising:

a submersible pump having an inlet and an outlet;

a frame assembly supporting said pump removably mounted thereto, said frame assembly comprising a base plate having an opening therethrough in flow communication with said pump inlet, said base plate including a guide means formed therein and having a plurality of legs attached to the bottom thereof for supporting said base plate, said base plate having at least two support members extending upwardly for supporting a top plate having a guide means formed therein alignable with said guide means of said base plate;

a guide rail defining a vertical longitudinal axis, said guide rail being complementary sized and shaped for slidably engaging said guide means of said top plate and said base plate, said guide rail being secured to a lift station wall by holding means;

a flexible discharge conduit removably attachable to said pump outlet; and means for lifting said frame assembly removably secured to said top plate for raising and lowering said frame slidably engaging said rail guide.

2. The universal pump coupling system of claim 1, wherein said frame is designed to hold said submersible pump in a fixed position with its discharge outlet angled outwardly from the lift station wall at a range of about 45 degrees to about 135 degrees.

3. The universal pump coupling system of claim 2, wherein said frame is designed to hold said submersible pump in a fixed position with its discharge outlet angled outwardly from the lift station wall at about 90 degrees.

4. The universal pump coupling system of claim 1, including an adapter for connecting said submersible pump outlet to said flexible discharge conduit, said adapter providing a means of orienting said pump outlet in a selected position.

5. The universal pump coupling system of claim 4, wherein said adapter forms an elbow.

6. The universal pump coupling system of claim 1, said pump outlet and said flexible discharge conduit being connected together by a quick disconnect assembly.

7. The universal pump coupling system of claim 1, wherein said flexible discharge conduit comprises a high strength ribbed suction hose.

8. The universal pump coupling system of claim 1, including:

a 90 degree elbow connecting at least one horizontal section of fixed discharge pipe to said flexible discharge conduit, a check valve connected to said fixed discharge pipe, a flowthrough valve connected to said discharge pipe, and a "T" or "cross" pipe connection connected to a receiving force main.

9. A universal pump coupling system, comprising:

a submersible pump having an inlet and an outlet;

a frame assembly supporting said pump removably mounted thereto and positioning said pump outlet from a wall, said frame assembly comprising a base plate having an opening therethrough in flow communication with said pump inlet, said base plate including a slotted guide means formed therein and having a plurality of legs attached to the bottom thereof for supporting said base plate, said base plate having a plurality of support members extending upwardly for supporting a top plate having a slotted guide means formed .therein alignable with said slotted guide means of said base plate;

an "I-beam" shaped fiberglass guide rail defining a vertical longitudinal axis, said guide rail being complementary sized and shaped for slidably engaging said guide means of said top plate and said base plate, said guide rail being secured to a lift station wall by holding means;

a flexible discharge conduit removably attachable to said pump outlet;

a pump adapter with a quick connect for connecting said flexible hose with said pump outlet; and above ground fixed discharge piping and valving with a quick connect for connecting said fixed discharge piping with said flexible hose;

friction reducing material lining said guide means of said top plate and said base plate;

electrical power and sensor means in electrical communication with said submersible pump, said electrical and sensor means in electrical connection being electrically connected with a panel board by cords having twist lock plugs; and means for lifting said frame assembly removably secured to said top plate for raising and lowering said frame slidably engaging said rail guide.

* * * * *